US008403710B2

(12) United States Patent
Chen et al.

(10) Patent No.: US 8,403,710 B2
(45) Date of Patent: Mar. 26, 2013

(54) FOOL-PROOF ELECTRIC CONNECTOR

(75) Inventors: Kuan-Wu Chen, Taipei (TW); Chia-Hung Kuo, Taoyuan (TW)

(73) Assignee: Bellwether Electronic Corp., Taoyuan County (TW)

( * ) Notice: Subject to any disclaimer, the term of this patent is extended or adjusted under 35 U.S.C. 154(b) by 0 days.

(21) Appl. No.: 13/234,086

(22) Filed: Sep. 15, 2011

(65) Prior Publication Data

US 2012/0322316 A1 Dec. 20, 2012

(30) Foreign Application Priority Data

Jun. 17, 2011 (TW) ..... 100211082 U

(51) Int. Cl.
*H01R 13/64* (2006.01)

(52) U.S. Cl. ..... 439/680

(58) Field of Classification Search ..... 439/680, 439/358

See application file for complete search history.

(56) References Cited

U.S. PATENT DOCUMENTS 6,464,542 B1 * 10/2002 Lee ..... 439/680
6,746,284 B1 * 6/2004 Spink, Jr. ..... 439/740

* cited by examiner

*Primary Examiner* — Phuong Dinh
(74) *Attorney, Agent, or Firm* — Chun-Ming Shih; HDLS IPR Services

(57) ABSTRACT

An electric connector includes a socket and a plug. The socket includes a first insulating block and a first terminal and the first insulating block has a positioning notch and a positioning hole. The plug includes a second insulating block and a second terminal, and the second insulating block has a plug end and a fool-proof block protruded from the plug end and extended towards the socket. The second insulating block includes a positioning hook arm formed on the other opposite side. When the second insulating block is plugged into the first insulating block, the fool-proof block is stopped at the positioning notch, and the positioning hook arm is latched into the positioning hole, such that the first terminals are electrically coupled to the second terminals, so as to assure a proper connection of the electric connectors and prevent damages caused by improper connection of the electric connectors.

21 Claims, 7 Drawing Sheets

FOOL-PROOF ELECTRIC CONNECTOR

FIELD OF THE INVENTION

The present invention generally relates to electric connectors, in particular to a fool-proof structure for connecting male and female connectors such as a plug and a socket.

BACKGROUND OF THE INVENTION

Traditionally, an electric connector cable is used for electrically coupling electronic products, and the electric connector cable is plugged into a port of an electronic product to transmit signals from the electronic product to another electronic product, so as to achieve the effect of connecting the electronic products.

Present existing electric connector cables generally has an electric connector at one end and another electric connector at the other end for connecting ports of the electronic products, so that when the electric connector cable is plugged into the ports, both male and female electric connectors are plugged, and terminals of the male and female electric connectors are contacted with one another to achieve the electric connection effect.

However, when the aforementioned male and female electric connectors are connected, the connectors may be plugged in a reverse wrong order or secured improperly, not only causing damages to the structure of the electric socket and plug, but also failing to achieve a correct electric connection and affecting the connection function between the electronic products. Therefore, it is a main subject for related manufacturers to assure a good connection between the two electric connectors and reduce damages of the electric socket and plug.

In view of the aforementioned drawbacks of the prior art, the inventor of the present invention conducted extensive researches and experiments, and finally provided a feasible solution and design in accordance with the present invention to overcome the drawbacks of the prior art.

SUMMARY OF THE INVENTION

Therefore, it is a primary objective of the present invention to provide a fool-proof electric connector to assure a good connection between the electric connectors to avoid damages of the electric connectors caused by an improper connection.

Another objective of the present invention is to provide a fool-proof electric connector having a plug fixed into a socket and maintain a correct electric connection of the terminals.

To achieve the foregoing objectives, the present invention provides a fool-proof electric connector, comprising a socket and a plug. The socket includes a first insulating block and a plurality of first terminals installed in the first insulating block. The first insulating block has a positioning notch formed on a side of the first insulating block and at least one positioning hole formed on the other opposite side of the first insulating block. The plug includes a second insulating block and a plurality of second terminals installed in the second insulating block. The second insulating block has a plug end, and a fool-proof block is formed at an edge of the plug end and protruded from the plug end and extended in a direction towards the socket, and at least one positioning hook arm disposed on the other opposite side of the second insulating block. When the second insulating block is plugged into the first insulating block, the fool-proof block is pressed and stopped at the positioning notch, and the positioning hook arm is latched into the positioning hole to electrically couple the first terminals to the second terminals.

To achieve the foregoing objectives, the present invention provides a fool-proof electric connector plugged into a socket having a positioning notch and at least one positioning hole. The electric connector includes a plug, and the plug includes a second insulating block and a plurality of second terminals installed in the second insulating block, and the second insulating block has a plug end, and the plug end includes a fool-proof block formed at an edge of the plug end and protruded from the plug end and extended towards the socket, and the second insulating block includes at least one positioning hook arm formed at the other opposite side. When the second insulating block is plugged into the socket, the fool-proof block is pressed and stopped at the positioning notch, and the positioning hook arm is latched into the positioning hole.

Compared with the prior art, the fool-proof electric connector of the present invention comprises the fool-proof block formed on a lateral side of the plug and extended towards the plugging direction and protruded from the end surface of the second insulating block, such that if a user plugs the plug into the socket in a wrong direction and without turning the plug by 180 degrees, the fool-proof block will be blocked outside the first insulating block, and the fool-proof block will be retracted and blocked outside the side panel by a reaction force, so that the present invention can serve as a fool-proof device of the electric connector to assure a proper connection between the socket and the plug and avoid damages of the electric connector structure caused by the improper connection.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 1:
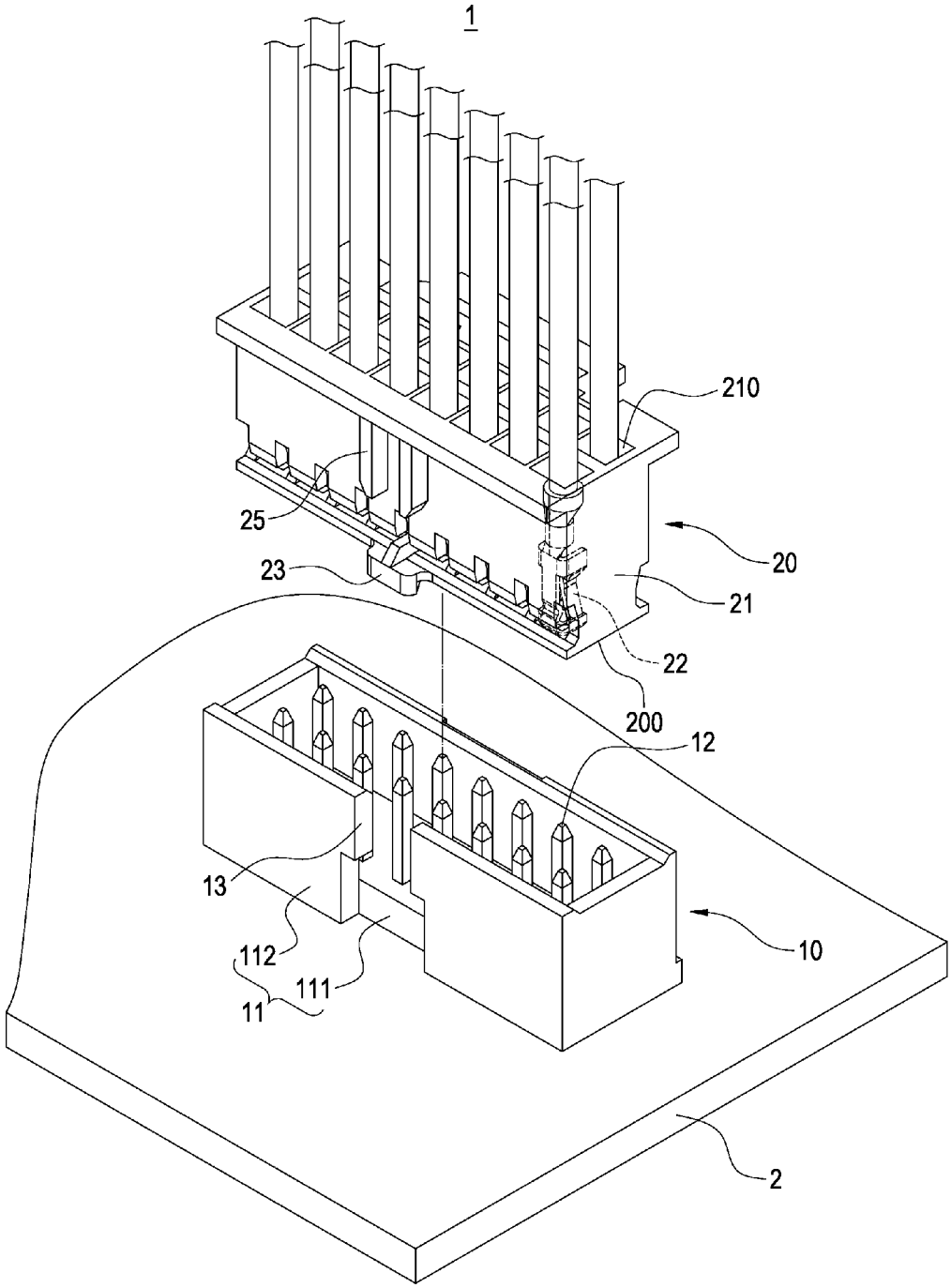
FIG. 1 is a schematic view of connecting a fool-proof electric connector of the present invention.
Figure 2:
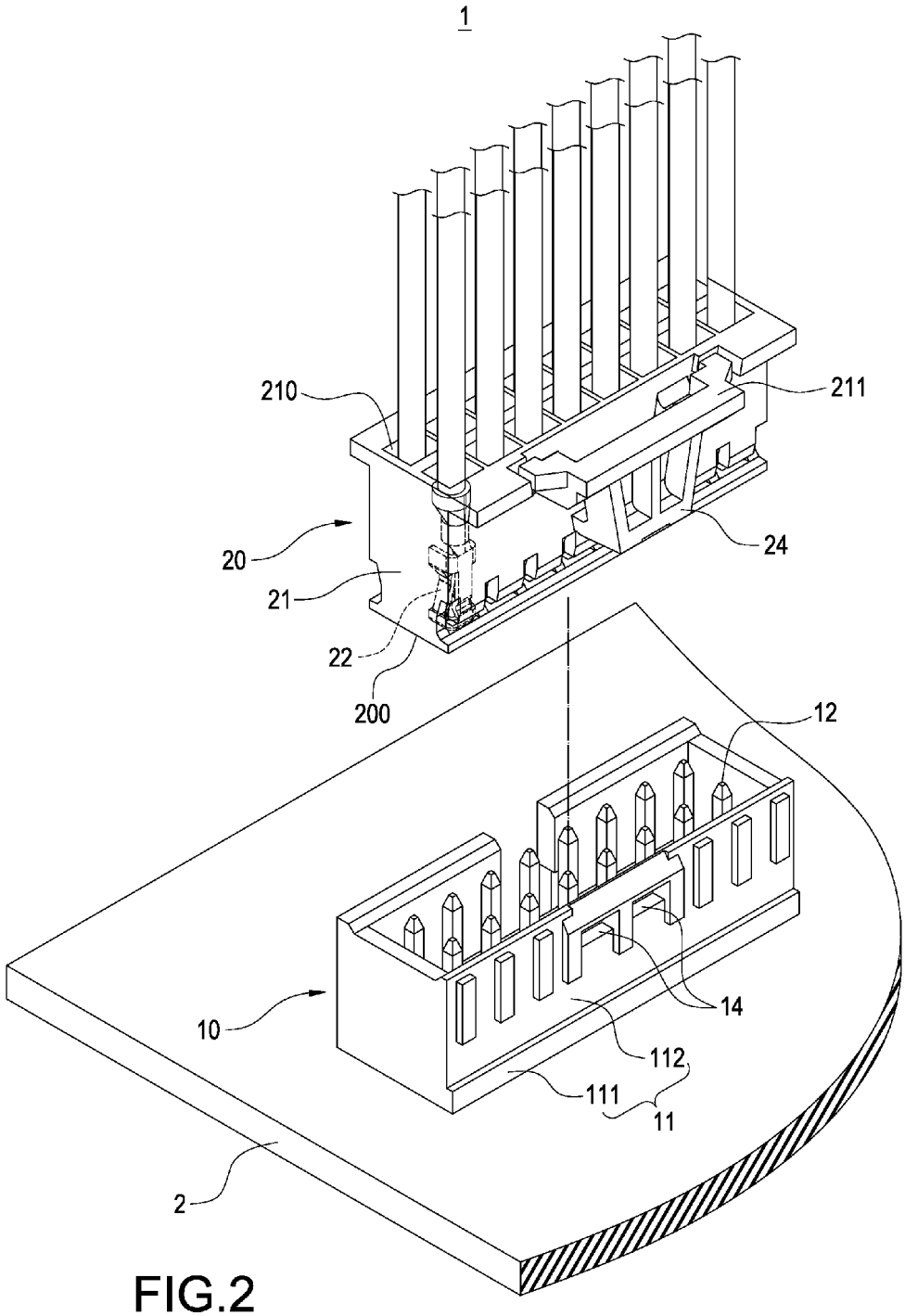
FIG. 2 is another schematic view of connecting a fool-proof electric connector of the present invention.

With reference to FIGS. 1 and 2 for schematic views of connecting a fool-proof electric connector of the present invention, the fool-proof electric connector 1 comprises a socket 10 and a plug 20.

The socket 10 includes a first insulating block 11, a plurality of first terminals 12 installed in the first insulating block 11, a positioning notch 13 formed on a lateral side of the first insulating block 11, and at least one positioning hole 14 formed at another opposite lateral side.

More specifically, in the structure of the socket 10, the first insulating block 11 includes a lower board 111 and a plurality of side panels 112 extended perpendicularly from the periphery of the lower board 111, wherein the first terminals 12 are plugged into the lower board 111, and the positioning notch 13 and the positioning hole 14 are formed on two opposite side panels 112 of the side panels 112 respectively. In addition, the positioning notch 13 is formed and opened in a direction parallel to the first terminals 12, and the positioning notch 13 is extended from a side edge of the side panel 112 to the other side edge and penetrated through the side panel 112.

In this preferred embodiment, the socket 10 is combined with a printed circuit board 2, and the quantity of the positioning holes 14 of the socket 10 is plural, and the positioning holes 14 are linearly arranged, and a specific distance is maintained parallel to an edge of the side panel 112.

The plug 20 includes a second insulating block 21 and a plurality of second terminals 22 installed in the second insulating block 21, and the second insulating block 21 has a plug end 200, a fool-proof block 23 formed at a distal edge of the plug end 200 and protruded from the plug end 200 and extended in a direction towards the socket 10, and at least one positioning hook arm 24 formed at the other opposite side of the second insulating block 21.

Figure 3:
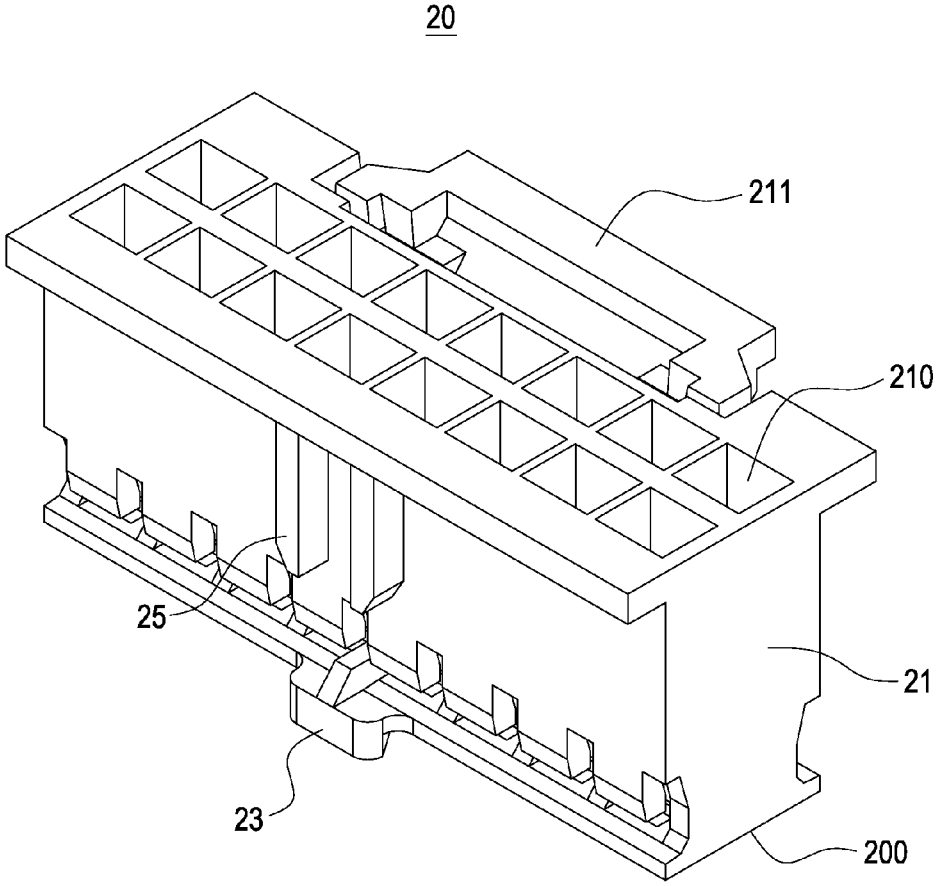
FIG. 3 is a perspective view of a second insulating block of the present invention.
Figure 4:
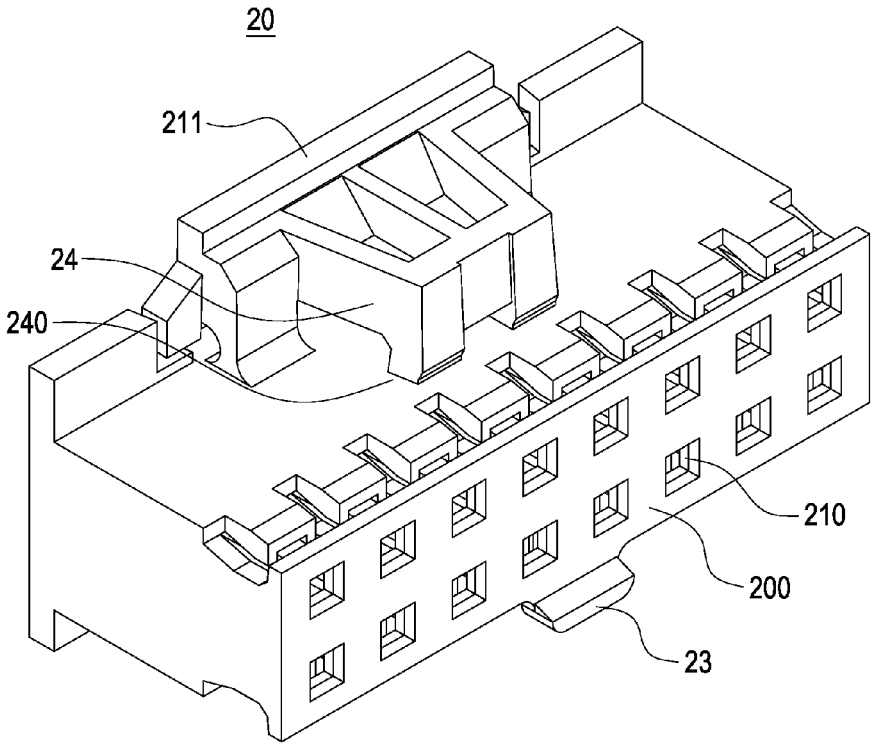
FIG. 4 is another perspective view of a second insulating block of the present invention.
Figure 5:
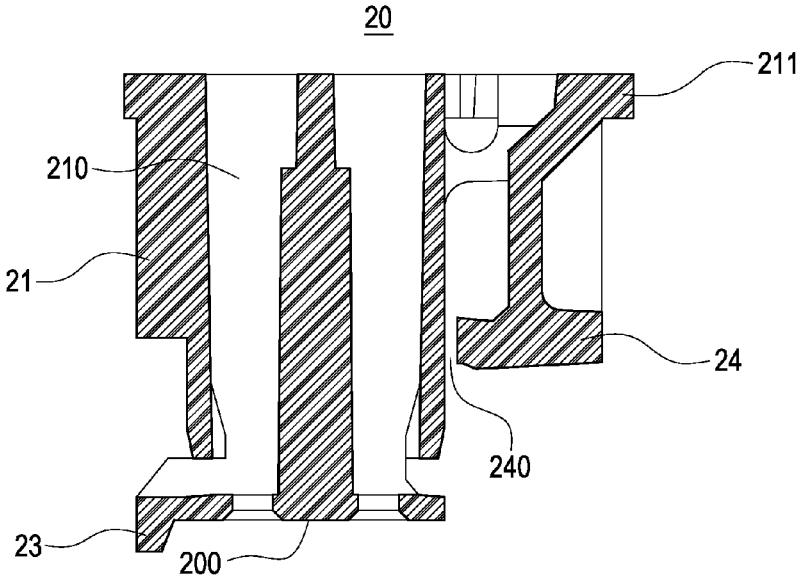
FIG. 5 is a cross-sectional view of a second insulating block of the present invention.

With reference to FIGS. 3 to 5 for perspective views and a cross-sectional view of a second insulating block in accordance with a preferred embodiment of the present invention, the fool-proof block 23 has a cross-section substantially in a trapezium shape, and a support wall 211 formed on a side of the second insulating block 21 and extended perpendicularly from the edge of the plug end 200, wherein the positioning hook arm 24 is formed on the support wall 211. In other words, the positioning hook arm 24 is extended in a direction from the support wall 21 towards the socket 10 and a gap 240 is maintained from the side of the second insulating block 21.

Further, the second insulating block 21 includes a plurality of second terminal slots 210 penetrated through the second insulating block 21 and coupled into the second terminal slots 210. The second insulating block 21 includes a pair of positioning ribs 25 formed on an internal side of the fool-proof block 23, such that when the plug 20 is plugged into the socket 10, the positioning ribs 25 are abutted against the two side edges of the positioning notch 13 respectively.

Figure 6:
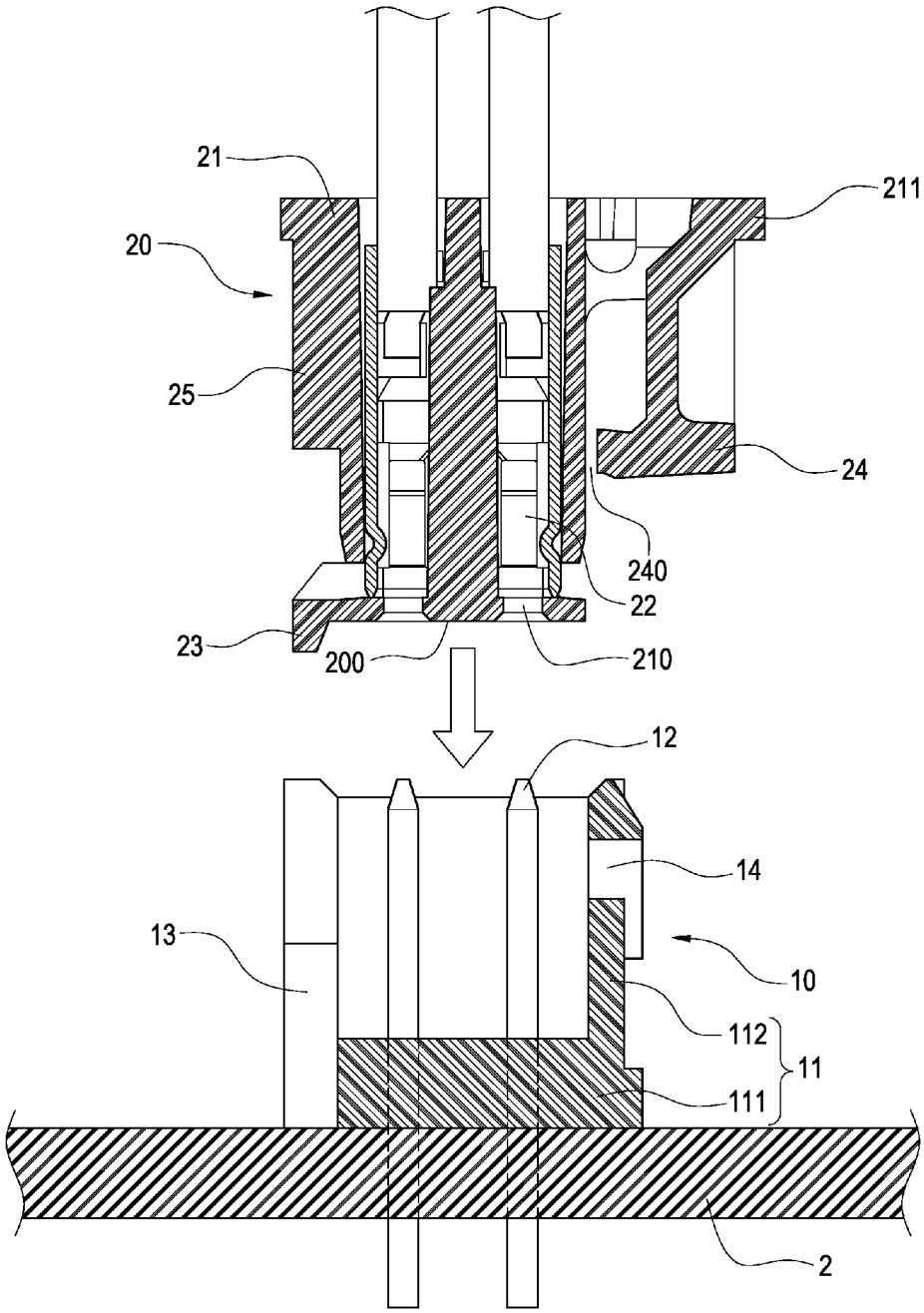
FIG. 6 is a schematic view of connecting a fool-proof electric connector of the present invention.
Figure 7:
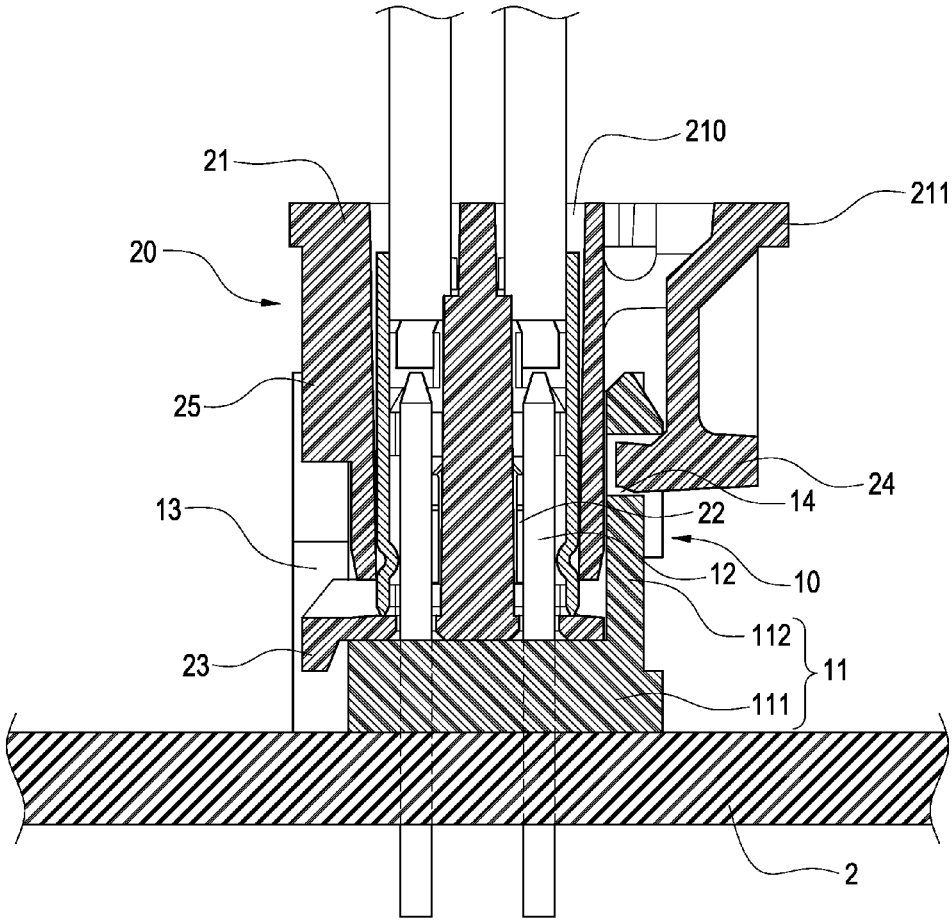
FIG. 7 is a cross-section view of a connected fool-proof electric connector of the present invention.

With reference to FIGS. 6 and 7 for a schematic view of connecting a fool-proof electric connector and a cross-sectional view of the connected fool-proof electric connector in accordance with a preferred embodiment of the present invention respectively, during use, the socket 10 and the plug 20 are connected with one another, and the fool-proof block 23 of the plug 20 and the pair of positioning ribs 25 are aligned precisely with the positioning notch 13 in order to plug the second insulating block 21 (or the plug end 200) into the first insulating block 11. Now, the first terminals 12 will be plugged into the corresponding second terminal slots 210 respectively, and the fool-proof block 23 is pressed and stopped at the positioning notch 13, and the positioning hook arm 24 is latched into the positioning hole 14, so that the first terminals 12 are electrically coupled to the second terminals 22.

Figure 8:
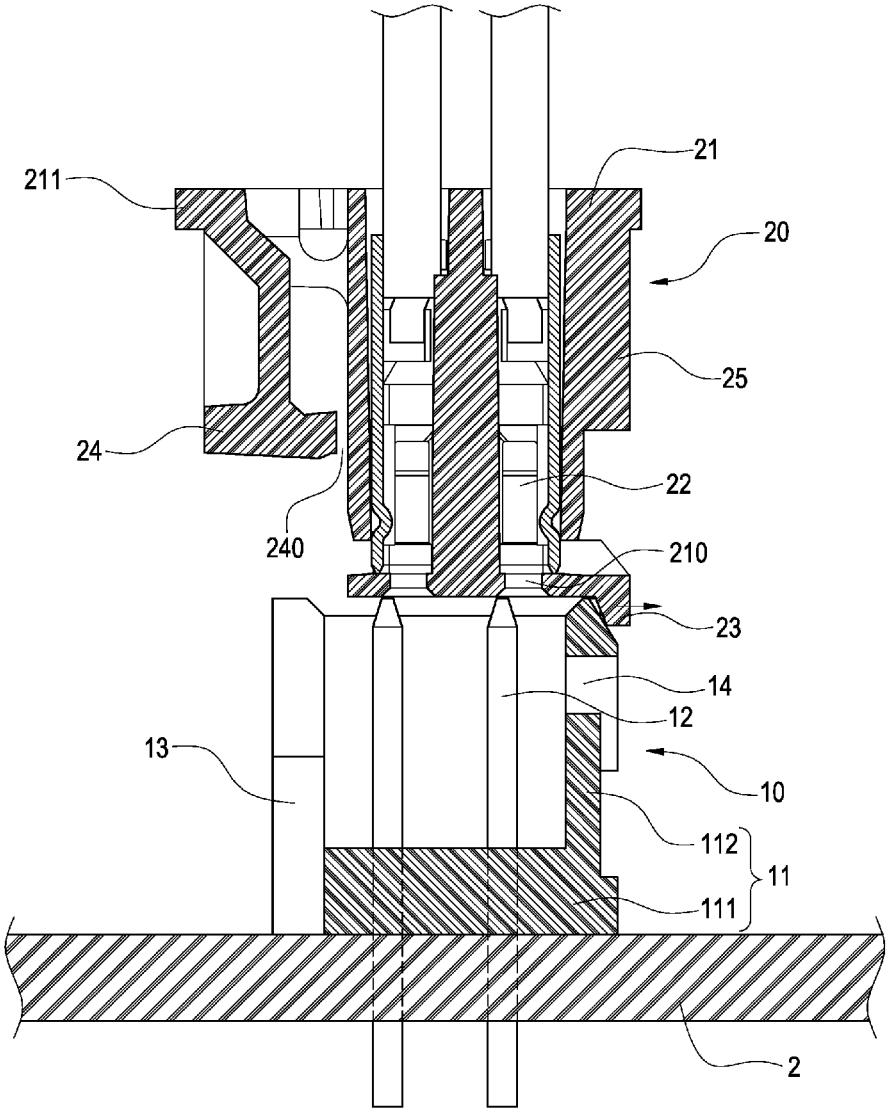
FIG. 8 is a schematic view showing the fool-proof effect of a fool-proof electric connector of the present invention.

With reference to FIG. 8 for a schematic view of the fool-proof effect of the present invention, if the electric connector 1 is connected in a wrong direction accidentally, and a user has not aligned the plug by turning the plug 20 (in 180 degrees) to plug the plug into the socket 10, then the fool-proof block 23 protruded from the distal end of the second insulating block 21 will be blocked outside by the side panel 112 of the first insulating block 11. If the side panel 112 and the fool-proof block 23 are compressed with each other, the fool-proof block 23 will be pushed and retracted to the outside of the side panel 112 by the reaction force of the side panel 112 to serve as a fool-proof device of the electric connector 1, so that the socket 10 and the plug 20 can be connected correctly to achieve the electric connection effect and avoid damages of the structure of the electric socket and plug.

While the invention has been described by means of specific embodiments, numerous modifications and variations could be made thereto by those skilled in the art without departing from the scope and spirit of the invention set forth in the claims.

What is claimed is:

1. A fool-proof electric connector, comprising:

a socket, including a first insulating block, a plurality of first terminals installed in the first insulating block, a positioning notch formed on a side of the first insulating block; and a plug, including a second insulating block, a plurality of second terminals installed in the second insulating block, a plug end of the second insulating block, a fool-proof block formed at an edge of the plug end and protruded from the plug end and extended in a direction towards the socket;

thereby, when the plug end is plugged into the first insulating block, the fool-proof block is pressed and stopped at the positioning notch, wherein the second insulating block includes a plurality of second terminal slots formed thereon, and the second terminals are coupled into the second terminal slots respectively.

2. The fool-proof electric connector of claim 1, wherein at least one positioning hole is formed on the other opposite side of the first insulating block, and at least one positioning hook arm is disposed on the other opposite side of the second insulating block, and the positioning hook arm is latched into the positioning hole, so that the first terminals are electrically coupled to the second terminals.

3. The fool-proof electric connector of claim 2, wherein the first insulating block includes a lower board and a plurality of side panels extended perpendicularly from the periphery of the lower board , and the lower board includes the first terminals inserted thereon, and the positioning notch and the positioning hole are formed on two opposite side panels respectively.

4. The fool-proof electric connector of claim 3, wherein the positioning notch is formed with an opening direction parallel to the first terminals, and the positioning notch is extended from a side edge of the side panel to the other side edge of the side panel and penetrated through the side panel.

5. The fool-proof electric connector of claim 4, wherein the positioning hole comes with a plural quantity and the positioning holes are linearly arranged, and maintained a distance from an edge parallel to the side panel.

6. The fool-proof electric connector of claim 1, wherein the second insulating block includes a pair of positioning ribs formed on an internal side of the fool-proof block and abutted against two side edges of the positioning notch respectively.

7. The fool-proof electric connector of claim 2, wherein the second insulating block includes a support wall formed on a lateral side of the second insulating block and extended perpendicularly from the edge of the plug end, and the positioning hook arm is formed on the support wall.

8. The fool-proof electric connector of claim 7, wherein the second insulating block includes a support wall formed on a lateral side of the second insulating block and extended perpendicularly from the edge of the plug end, and the positioning hook arm is formed on the support wall.

9. The fool-proof electric connector of claim 8, wherein the positioning hook arm is extended in a direction from the support wall to the socket.

10. The fool-proof electric connector of claim 8, wherein the positioning hook arm maintains a gap from the lateral side of the second insulating block.

11. The fool-proof electric connector of claim 1, wherein the fool-proof block has a cross-section substantially in a trapezium shape.

12. A fool-proof electric connector, comprising:

a socket, including a first insulating block, a plurality of first terminals installed in the first insulating block, a positioning notch formed on a side of the first insulating block, at least one positioning hole formed on the other opposite side of the first insulating block; and a plug, including a second insulating block, a plurality of second terminals installed in the second insulating block, a plug end of the second insulating block, a fool-proof block formed at an edge of the plug end and protruded from the plug end and extended in a direction towards the socket;

thereby, when the plug end is plugged into the first insulating block, the fool-proof block is pressed and stopped at the positioning notch, wherein the first insulating block includes a lower board and a plurality of side panels extended perpendicularly from the periphery of the lower board, and the lower board includes the first terminals inserted thereon, and the positioning notch and the positioning hole are formed on two opposite side panels respectively.

13. The fool-proof electric connector of claim 12, wherein at least one positioning hook arm is disposed on the other opposite side of the second insulating block, and the positioning hook arm is latched into the positioning hole, so that the first terminals are electrically coupled to the second terminals.

14. The fool-proof electric connector of claim 12, wherein the positioning notch is formed with an opening direction parallel to the first terminals, and the positioning notch is extended from a side edge of the side panel to the other side edge of the side panel and penetrated through the side panel.

15. The fool-proof electric connector of claim 14, wherein the positioning hole comes with a plural quantity and the positioning holes are linearly arranged, and maintained a distance from an edge parallel to the side panel.

16. The fool-proof electric connector of claim 13, wherein the second insulating block includes a pair of positioning ribs formed on an internal side of the fool-proof block and abutted against two side edges of the positioning notch respectively.

17. The fool-proof electric connector of claim 16, wherein the second insulating block includes a support wall formed on a lateral side of the second insulating block and extended perpendicularly from the edge of the plug end, and the positioning hook arm is formed on the support wall.

18. The fool-proof electric connector of claim 13, wherein the second insulating block includes a support wall formed on a lateral side of the second insulating block and extended perpendicularly from the edge of the plug end, and the positioning hook arm is formed on the support wall.

19. The fool-proof electric connector of claim 18, wherein the positioning hook arm is extended in a direction from the support wall to the socket.

20. The fool-proof electric connector of claim 18, wherein the positioning hook arm maintains a gap from the lateral side of the second insulating block.

21. The fool-proof electric connector of claim 12, wherein the fool-proof block has a cross-section substantially in a trapezium shape.

* * * * *